US005665408A

United States Patent [19]

Coupe et al.

[11] Patent Number: 5,665,408

[45] Date of Patent: Sep. 9, 1997

[54] PACKAGING FOR FOODSTUFFS AND WRAPPED FOODSTUFF USING SUCH PACKAGING

[75] Inventors: James Coupe, Verriere le Buisson; Michel Flament, Marcoussis, both of France

[73] Assignee: Societe Civile BK, Paris, France

[21] Appl. No.: 424,632

[22] Filed: Apr. 19, 1995

[30] Foreign Application Priority Data

Apr. 20, 1994 [FR] France ..... 94 04719

[51] Int. Cl.[6] ..... B65D 85/00

[52] U.S. Cl. ..... 426/113; 426/118; 426/395; 426/412; 206/550; 220/745; 220/DIG. 27; 383/103

[58] Field of Search ..... 426/118, 395, 426/113, 412; 220/745, 748, 749, DIG. 27, 366.1; 383/103; 206/550

[56] References Cited

U.S. PATENT DOCUMENTS

| | | | |
|---|---|---|---|
| 3,949,934 | 4/1976 | Goglio | 426/412 |
| 4,444,219 | 4/1984 | Hollenstein | 426/118 |
| 4,890,637 | 1/1990 | Lamparter | 383/103 |
| 5,326,176 | 7/1994 | Domke | 426/118 |
| 5,519,994 | 5/1996 | Goglio | 426/118 |

FOREIGN PATENT DOCUMENTS

| | | |
|---|---|---|
| 0 156 404 | 10/1985 | European Pat. Off. . |
| 0 547 941 | 6/1993 | European Pat. Off. . |
| 2 629 060 | 9/1989 | France . |

*Primary Examiner*—Lien Tran
*Attorney, Agent, or Firm*—Young & Thompson

[57] ABSTRACT

Packaging for foodstuffs comprising a device for automatic closure at the end of cooking. The automatic closure device (15) comprises a first chamber (38) communicating with the outside and enclosing a valve and second chamber (40) communicating with the first chamber and enclosing a block of thermofusible material, such second chamber communicating with the interior of the packaging by a channel of small cross section (41). During cooking, the gases can leave freely from the packaging and, at the onset of cooling, the valve prevents air from penetrating the packaging while the thermofusible material solidifies in the channel of small cross section.

8 Claims, 1 Drawing Sheet

PACKAGING FOR FOODSTUFFS AND WRAPPED FOODSTUFF USING SUCH PACKAGING

FIELD OF THE INVENTION

The invention relates to a packaging for foodstuffs, adapted to receive foods to be cooked at least partially in situ; it relates particularly to an improvement such of packaging, in the form of an automatic closure device, permitting bagging the products to be treated without drawing a vacuum and no matter what their temperature and ensuring cooking in situ with evacuation of steam and other gaseous products resulting from the cooking and finally ensuring the automatic closure and the natural drawing of a vacuum in the course of cooling. The invention also covers all foodstuffs wrapped in such a packaging.

BACKGROUND OF THE INVENTION

Precooked foods and food preparations are the object of increasingly greater demand, but the production of such packages introduces problems, particularly on an industrial scale. A known process consists, after cooking, in placing the raw or pretreated foodstuffs in a bag, creating a sufficient vacuum in the bag and closing it by thermowelding. The vacuum must be of the order of 98%. There are currently used bags of plastic material having a thickness of about 90 microns. The process is carried out in a vacuum chamber including thermowelding means. Such a machine is currently considered "manual", because it requires an operator and the production speed is low.

On an industrial scale, the process is necessarily different and the difficulties are different. There is used a thermoforming machine comprising two rolls of plastic film unrolled one above the other. The lower film passes on a perforated recessed plate located in a vacuum chamber. The interior of the film is hollowed within the recess under the conjoint effect of temperature and underpressure existing at the bottom of the recess. Raw or pretreated foodstuffs are placed in the hollowed portion, then the upper film is deposited and thermowelded to the lower hollow film, so as to define a hermetically closed wrapping containing a quantity of foodstuff.

This wrapping method is difficult to practice when certain hot foodstuffs have a liquid or pasty consistency (for example sauces) and are in danger of being drawn outside the package in the course of formation, because of placing it under vacuum. In this case the vacuum obtained is not sufficient, and residual air is present.

French patent application 2 629 060 discloses a system of automatic closure for a package in which the foodstuffs can be cooked. This device comprises a simple valve permitting air, steam and gaseous products produced during cooking to leave freely in the course of this cooking; it theoretically avoids external air penetrating the packaging at the time of cooling. The device as disclosed is however too simple and does not permit achieving sufficient reliability for industrial use. Particularly, the valve is in danger of opening in the course of the period of storing, causing the packaging to lose its quality of a sterile container. Thus, a substantial portion of the production is in danger of losing the benefit of pasteurization in situ and certain food preparations can prove to be damaged upon opening the package.

SUMMARY OF THE INVENTION

The invention provides a package provided with an improved automatic closure device, suitable to solve all the problems recited above, while permitting reliable use on an industrial scale.

More particularly, the invention therefore relates to a package for foodstuffs, adapted to receive foods to be cooked at least partly in situ, characterized in that it comprises, fixed in a sealed fashion through one wall of the latter, an automatic closure device comprising: a first chamber communicating with the outside and enclosing a valve, a second chamber communicating with said first chamber through a passage adapted to be closed by said valve, a channel of small cross section extending between this second chamber and the interior of the packaging and a block of thermofusible material disposed in said second chamber.

In the preceding description, the automatic closure device which is present in the form of a small insert of rigid plastic material, can be adapted to any type of known packaging of flexible or semi-rigid plastic material, for example bags or trays. Thereafter, the filling with a foodstuff can be effected at atmospheric pressure and at no matter what temperature, with raw or pretreated foods. The cooking or final phase of cooking takes place in the package but the valve remains open and the foods are not isolated from the cooker during the cooking cycle. Because of this, air, steam and gaseous products given off by the materials themselves during cooking can escape freely from the package such that the foods are cooked exactly as if they were loose in the cooker. Upon cooling, the thermofusible material solidifies in the channel of the small cross section.

According to a notable characteristic of the invention, the valve does not have for its only purpose maintaining the vacuum in the package during the entire period of storage. Its principal role is to retain the block of thermofusible material when it softens or liquefies during cooking. This latter could be destroyed or at least damaged, or even expelled from its recess by being first entrained by the gases leaving at high speed during cooking and then sucked within the packaging during the period of cooling. The valve also has for its function to prevent the entry of air after cooking; this air could cool the thermofusible material too quickly and prevent it from closing the channel of small cross section.

In other words, the valve permits maintaining the thermofusible material in said second chamber during cooking and so acts that it will not be completely drawn into the interior of the packaging during cooling. Thus, the air not being able to enter the package, the thermofusible material is maintained in the channel of small cross section only by the vacuum created in the packaging when the steam which it contains condenses. The thermofusible material solidifies in the channel of small cross section and closes this latter definitively, which guarantees the isolation of the treated foodstuffs for a period of time corresponding to the lifetime of the products. This hermetic vacuum closure of the package is not lost if subsequently the valve detaches from its seat.

It is to be noted that this type of package is particularly adapted for cooking in a vacuum steam cooker, of the type described for example in French patent 2 674 116 of the applicant. Bags of the product to be cooked, hermetically closed by thermoforming machines, cannot generally be used in such a cooker because the bags inflate during the initial phase of injection of steam into the cooker. Then, the condensation ultimately created in the cooker to control the temperature by acting on the vacuum in this latter will increase the stresses on the bags. Unless made of a particularly strong and hence costly material, the packages are in danger of bursting in the course of cooking. The invention also permits solving this particular problem. In any case, the films of plastic material used can be thinner (particularly of a thickness less than 90 microns) which permits enjoying economy in wrapping.

The invention also relates to a wrapped food product, precooked in a package, this latter being hermetically closed at the end of cooking, characterized in that said package comprises, secured in a sealed manner through a wall of the latter, an automatic closure device comprising a first chamber communicating with the outside and enclosing a valve, a second chamber communicating with said first chamber through a passage adapted to be closed by said valve, a channel of small cross section extending between said second chamber and the interior of the package, and thermofusible material closing said channel.

The thermofusible material can consist of a paraffin "doped" with a synthetic product of polyethylene base, known per se.

The invention comprises a particular advance in the field of industrial vacuum packing of foodstuffs. Because the filling of the bags can be effected at atmospheric pressure, and at any temperature, the liquid or pasty products are not in danger of being sucked out upon the application of vacuum to the bag. Moreover, this application of vacuum takes place by condensation of the steam remaining in the package at the end of cooking, the final and reliable closure of said package taking place after a process of pasteurization of the foodstuffs, carried out under optimum hygienic conditions.

BRIEF DESCRIPTION OF THE DRAWINGS

The invention will be better understood and other advantageous characteristics of the latter will appear more clearly in the light of the description which follows, given solely by way of example and with respect to the accompanying drawings, in which.

DETAILED DESCRIPTION OF THE INVENTION

Figure 1:
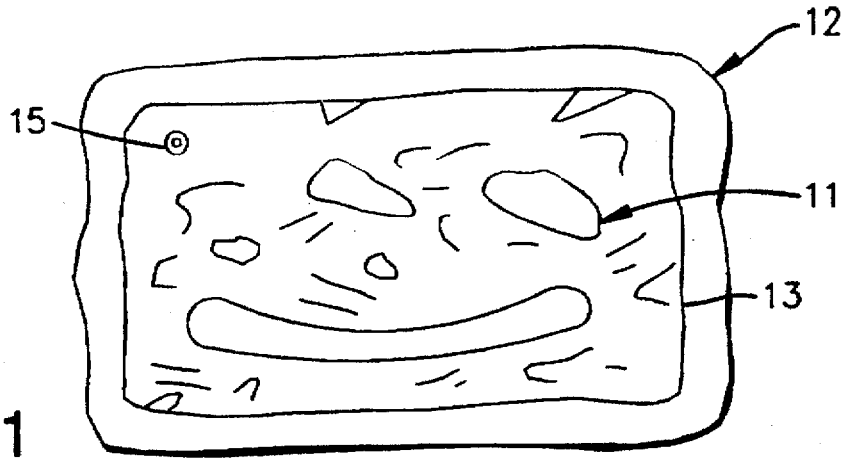
FIG. 1 shows schematically a wrapped foodstuff, enclosed in a package according to the invention, in which it has been cooked at least in part.

In FIG. 1, there is shown a foodstuff 11 wrapped for subsequent consumption. The wrapping constitutes a package which in this case is a bag 12 of flexible plastic material itself formed by two sheets of plastic material thermowelded to each other so as to enclose the foodstuffs. There is shown in FIG. 1 a peripheral thermowelding line 13 defining the bag. This type of packaging can easily be made by an automatic wrapping machine in which the foods are disposed between two films of thermoplastic material, at atmospheric pressure, before the bags are produced by thermowelding.

According to an important characteristic of the invention, one of the walls of bag 12 is provided with automatic closure device 15 sealingly secured (for example also by thermowelding) through said wall. This device permits at least partially cooking the food in the bag 12, which is to say after the wrapping operation that produces the weld 13.

Figure 2:
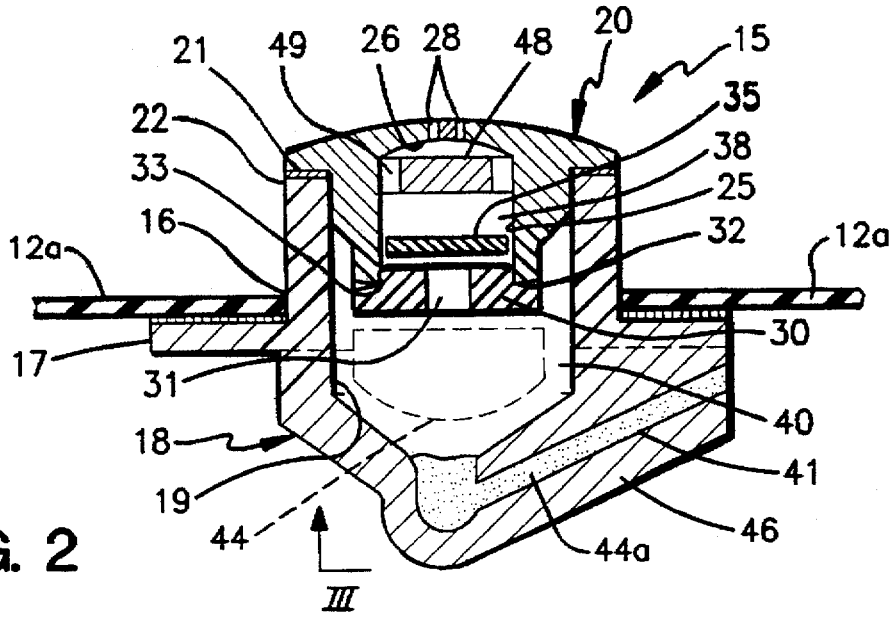
FIG. 2 is an elevational view, in cross section and on a larger scale, of the automatic closure device with which the package of FIG. 1 is provided.
Figure 3:
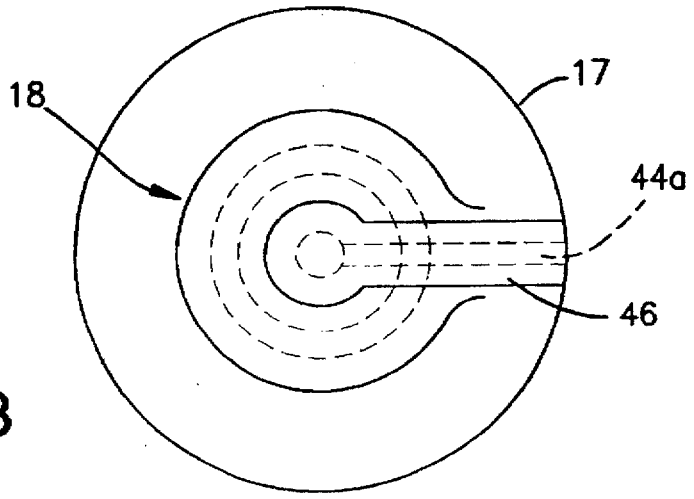
FIG. 3 is a view in the direction of the arrow III of FIG. 2.

FIGS. 2 and 3 show in a detailed fashion the structure of the automatic closure device 15. This latter is in the general shape of an insert of rigid plastic material mounted through a hole 16 in a wall 12*a* of the bag 12. It is provided with an annular collar 17 welded hermetically to this wall 12*a*. The device 15 comprises essentially a hollow body 18 in which is defined a first recess 19 and a cap 20 sealingly assembled to said body, by a weld 21 extending about the edge 22 of said first recess. The hollow body 18 is comprised by a cylindrical portion prolonged by a conical portion. The collar 17 is of one piece with the outside of the cylindrical portion. The cap 20 comprises a second recess 25 having in its lower wall 26 at least one hole and preferably several holes 28 of small cross section adapted to establish communication between the recess 25 and the outside. In the example, there are shown four holes of 0.4 mm diameter. A partition element 30 through which is provided a central passage 31 is assembled on the cap 20 by a weld 32 extending entirely about the edge 33 of said second recess 25. A movable valve member 35 is retained in the first recess between the hole 28 and the partition element 30.

Thus the automatic closure device 15 comprises a first chamber 38 defined in the cap 20 and sheltering the valve 35, communicating through the holes 28 with the outside of the package and a second chamber 40 communicating with said first chamber through the passage 31 adapted to be closed by the valve 35. This second chamber is defined by the space left available at the bottom of said first recess 19 by the cap 20 engaged partially in this latter. A channel 41 of small cross section extends between said second chamber and the interior of the package. Having regard for the thermoplastic material indicated above, such a channel will have a length of about 1 cm and a diameter of about 1 mm.

The second chamber 40 encloses, before utilization (which is to say before cooking the materials in situ) a block of thermofusible material 44 shown in broken line in FIG. 2. This block is simply retained imprisoned in the said second chamber, it is not adhered to the internal wall of the recess. As a result, even at the beginning of cooking, it does not prevent gaseous circulation from the interior of the package to the outside. For the same reason, the valve 35 has a diameter less than that of the recess 25 such that, when it is not applied against the partition element 30 forming a seat, the valve does not prevent the evacuation of gaseous products toward the interior of the cooker, through the holes 28. It is to be noted that the bottom wall 26 of the second recess 25 is domed and that a flat insert 48 provided with peripheral notches 49 is interposed in said second recess between said valve 35 and the holes 28. The valve 35 comes into abutment against this insert 48 when it is pressed by the flow of gases evacuated from the packaging but these gases can escape by flowing around the valve through the notches 49.

The channel 41 is provided in a radial rib 46 extending between one end of the body 18, at the bottom of the recess 19, and the collar 17. It opens into the packaging in the immediate vicinity of this rigid collar, at a position in which there is no danger that it will be closed by the product contained in the package or by its flexible wall when the internal space is placed under vacuum. Moreover, this radial rib 46 permits defining a channel 41 of a desired length without increasing the height of the automatic closure device.

When the packaging contains a foodstuff which has been cooked in situ, the plug 44 has lost its shape and the fusible material 44*a* is engaged in the conduit 41 under the influence of the condensation of steam in the bag during cooling. This is the condition shown in FIG. 2. More precisely, the behavior of the automatic closure device during production of the packaging is as follows.

The consumable products assembled to form a given foodstuff are first introduced into the bag 12 and the latter is closed by thermowelding. For example, in the case of FIG. 1, the foodstuff can be introduced between two strips of flexible material unrolling continuously and this package is individualized by a peripheral thermoweld 13 surrounding the foodstuff. Preliminarily, automatic closure devices 15 are fixed to one of the strips, at selected positions regularly spaced apart, so that each package will comprise such a device at a predetermined position. All these operations and the apparatus which perform them are within the skill of the art.

Then, the foodstuffs thus wrapped are subjected to a cooking operation. For example and preferably, such packages, which have been filled at atmospheric pressure, are introduced into a steam cooker operating under vacuum, of the type indicated above. From the outset of cooking, communication is possible between the interior of the package and the exterior of the latter such that gases escape at high speed while pressing the valve 35 against the insert 48, during all of cooking. There is thus obtained a natural pasteurization of the cooked foodstuff in the package. During this time, the plug of thermofusible material 44 softens but remains nevertheless within the device because of the presence of the valve 35. Then, in the course of cooling, the steam remaining in the package begins condensing which results in the immediate closure of the valve 35 and preventing the relatively cold air from entering the package. Because of this, the thermofusible material is not in danger of resolidifying too rapidly and is drawn into the channel 41 only by the vacuum force resulting from the condensation of steam in the package. No reverse circulation of cold gas can disturb the solidification of thermofusible material in this channel. After cooling, the package is definitively hermetically sealed and encloses the completely pasteurized foodstuff.

We claim:

1. Package for foodstuffs, adapted to receive food to be cooked at least in part in situ, said package comprising: an automatic closure device fixed in sealed manner through one wall (12*a*) of the package, said automatic closure device comprising a first chamber (38) communicating with the outside and enclosing a valve (35), a second chamber (40) communicating with said first chamber through a passage (31) adapted to be closed by said valve, a channel (41) of small cross section extending between said second chamber and the interior of the package, and a block of thermofusible material (44) disposed in said second chamber, whereby said block of thermofusible material will soften during cooking, flow into said channel and upon cooling solidify therein to provide a hermetic seal.

2. Package according to claim 1, wherein the automatic closure device (15) is comprised by a body (18) provided with an annular collar (17) and in which are provided a first recess (19) and said channel (41), said channel extending between one end of said first recess and the outside of said body, and by a cap (20) fixed sealingly to said body about an edge of said first recess (19), said first chamber and said passage being defined in said cap, and said second chamber being defined by the space left free at the bottom of said first recess by said cap.

3. Package according to claim 2, wherein the cap (20) comprises a second recess (38) provided with at least one hole (28) adapted to establish communication with the outside, and a partition element (30), through which is provided said passage (31), is fixed to said cap about an edge of said recess (25), said valve being retained in said second recess by said partition element.

4. Package according to claim 3, wherein an insert (48) provided with peripheral notches (49) is interposed within said second recess between said valve and said hole.

5. Wrapped foodstuff, precooked in a package, said package being hermetically closed at the end of cooking, and comprising an automatic closure device fixed sealingly through one wall (12*a*) of the package, the automatic closure device (15) comprising a first chamber (38) communicating with the outside and enclosing a valve (35), a second chamber (40) communicating with said first chamber through a passage (31) adapted to be closed by said valve, a channel (41) of small cross section extending between said second chamber (40) and the interior of the package and thermofusible material (44*a*) closing said channel.

6. Wrapped foodstuff according to claim 5, wherein the automatic closure device (15) is comprised by a body (18) provided with an annular collar (17) and in which are provided a first recess (19) and said channel (41), said channel extending between one end of said first recess and the outside of said body and by a cap (20) fixed sealingly to said body about an edge of said first recess (19), said first chamber and said passage being defined in said cap, and said second chamber being defined by the space left free at the bottom of said recess by said cap.

7. Wrapped foodstuff according to claim 6, wherein the cap (20) comprises a second recess (25) provided with at least one hole (28) adapted to establish communication with the outside, and a partition element (30), through which is provided said passage (31), is secured to said cap about an edge of said second recess (25), said valve being retained in said second recess by said partition element.

8. Wrapped foodstuff according to claim 7, wherein an insert (48) provided with peripheral notches (49) is interposed in said second recess between said valve and said hole.

* * * * *